US006036134A

United States Patent [19]

Moody

[11] Patent Number: 6,036,134

[45] Date of Patent: Mar. 14, 2000

[54] SPINDLE SLEEVE FOR USE IN APPARATUS FOR DISPENSING PRODUCT FROM A ROLL

[75] Inventor: John R. Moody, Neenah, Wis.

[73] Assignee: Fort James Corporation, Deerfield, Ill.

[21] Appl. No.: 09/001,537

[22] Filed: Dec. 31, 1997

[51] Int. Cl.[7] ..... B65H 16/04; B65H 18/04; B65H 75/24

[52] U.S. Cl. ..... 242/422.4; 242/422.9; 242/597.6; 242/596.7; 242/597.8; 242/571.5; 312/34.22

[58] Field of Search ..... 242/422.4, 422.9, 242/597.5, 597.6, 597.7, 596.7, 599.3, 597.8, 571.5; 312/34.22

[56] References Cited

U.S. PATENT DOCUMENTS

| | | | |
|---|---|---|---|
| 1,647,109 | 10/1927 | Miller | 242/571.5 |
| 2,487,763 | 11/1949 | Patterson et al. . | |
| 3,010,670 | 11/1961 | Jones et al. . | |
| 3,140,059 | 7/1964 | Lusebrink . | |
| 3,211,504 | 10/1965 | Bump . | |
| 3,294,329 | 12/1966 | Tucker et al. . | |
| 3,375,995 | 4/1968 | Roman . | |
| 3,381,909 | 5/1968 | Tucker et al. . | |
| 3,637,276 | 1/1972 | Bump . | |
| 3,656,699 | 4/1972 | Schnyder et al. . | |
| 3,770,221 | 11/1973 | Stern | 242/422.4 |
| 4,375,874 | 3/1983 | Leotta et al. . | |
| 4,998,681 | 3/1991 | McNeill . | |
| 5,125,586 | 6/1992 | Whitehorn . | |
| 5,265,816 | 11/1993 | Collins . | |
| 5,277,375 | 1/1994 | Dearwester . | |
| 5,366,175 | 11/1994 | Schutz . | |
| 5,370,336 | 12/1994 | Whittington . | |
| 5,370,339 | 12/1994 | Moody et al. . | |
| 5,524,835 | 6/1996 | Collins . | |
| 5,556,054 | 9/1996 | Neveu et al. . | |

*Primary Examiner*—John Q. Nguyen
*Attorney, Agent, or Firm*—Burns Doane Swecker & Mathis, LLP

[57] ABSTRACT

A spindle sleeve for use in an apparatus for dispensing sheet material, preferably toilet tissue, preferably the apparatus dispenses alternately from two rolls and includes a housing and roll support spindles for supporting the rolls in coaxial spaced relationship relative to the housing. A spindle sleeve having a plurality of slotted openings is disposed over the roll support spindles for insertion into the roll of sheet material. The slotted openings form a plurality of finger elements which, upon insertion into the roll, compress against and frictionally engage the roll support spindle, thereby increasing the rotation resistance of the spindle sleeve relative to the roll support spindle.

26 Claims, 7 Drawing Sheets

SPINDLE SLEEVE FOR USE IN APPARATUS FOR DISPENSING PRODUCT FROM A ROLL

TECHNICAL FIELD

This invention relates to an apparatus for dispensing product from a roll thereof, and more particularly, to a spindle sleeve for use on the roll support spindle thereof.

BACKGROUND OF THE INVENTION

It is known in the prior art to employ dispensers holding a single roll of sheet material, such as toilet tissue. It is further known to employ dispensers holding two or more rolls of sheet material, such as toilet tissue, which maintain at least one of the rolls as a reserve roll while the sheet material is being dispensed from the other roll. Such devices are usually, but not exclusively, employed in institutional environments such as public rest rooms.

A prior dispenser of this second type is shown generally in FIGS. 1 and 2, and is more fully disclosed in copending application U.S. Ser. No. 08/728,208, filed Oct. 10, 1996, the entire contents of which are hereby incorporated by reference. The dispenser 10 of FIGS. 1 and 2 include a housing 16 having ends 12, 14 which define the housing interior. The housing 16 includes a first housing member 18 for attachment to a wall or other support surface and a second housing member 20 which is pivotally connected to the first housing member and movable between an open and closed position. Pivotal movement takes place about a pivot rod 22 to which the housing members are connected and a latch 24 of any suitable type is utilized to latch the housing members closed during dispensing of toilet tissue from the dispenser apparatus.

Also pivotally mounted on the pivot rod 22 is roll support means including a support frame 30 having axially aligned roll support spindles 32, 34 projecting outwardly from the support frame and away from each other. Support frame 30 defines an opening 36 therein. Support frame 30 includes a bifurcated projection 38 from which depends a toilet tissue roll end engagement member 40 in the form of a flat plate which is freely pivotally mounted to the projection. Gravity will urge the toilet tissue roll end engagement member or plate 40 to the vertical condition, if no outside forces are applied thereto. The toilet tissue roll end engagement member 40 is pivotally mounted on the support frame 30 at a location between the roll support spindles 32, 34 with the member or plate 40 positioned in the space defined by adjacent ends of toilet tissue rolls supported by the roll support spindles. A rib 39 projects from second housing member 20 and is received by bifurcated projection 38 when the second housing member 20 is closed to add structural stability.

As shown, a toilet tissue roll 42 is mounted on one of the roll support spindles 32, 34. The roll support means including support frame 30 and roll support spindles 32, 34 is pivotally movable. That is, pivotal movement of the support frame relative to the first housing member causes the roll support spindles to move either toward or away from the first housing member. The roll support means as shown in FIG. 1 illustrates the front or second housing member 20 when pivoted to an open position facilitating replenishment of toilet tissue rolls during servicing of the dispenser apparatus. Pivotal movement of the support frame, as well as the distance the roll support spindles may be moved away from the first housing member, is limited by an extension 48 of the support frame 30 which has a distal end 50 projecting into the confines of an opening 52 formed in a stabilizer plate 54 projecting outwardly from the back wall of the first housing member.

Opening 36 in support frame 30 receives stabilizer plate 54 when the support frame is in the closed position to stabilize not only the support frame but also the roll support spindles and the toilet tissue rolls supported thereon. Preferably opening 36 is so dimensioned or restricted as to provide engagement between the support frame and the stabilizer plate when the support frame has been pivoted upwardly into its dispensing position.

Front or second housing member 20 defines an opening 58 accommodating a cover 60 slidably movable within the opening 58 relative to the second housing member. The cover 60 is movable between a first cover location wherein a first roll of toilet tissue is exposed for user access and a second roll of toilet tissue is concealed or otherwise not exposed for user access and a second cover location wherein the second roll of toilet tissue is exposed for user access and a first roll of toilet tissue is concealed or otherwise not exposed for user access. That is, the cover 60 may be slid relative to the second housing member 20 by a manual force being exerted thereon between the first and second cover locations. At its upper edge cover 60 defines a slot which receives second housing member 20 where the second housing member defines opening 58. At its lower edge cover 60 is received within a slot defined by the second housing member and a longitudinally extending reinforcement member 64.

Locking means is provided for locking the cover against slidable movement relative to the second housing member between the first and second cover locations until substantial depletion of one of the rolls of toilet tissue. The above-described toilet tissue roll end engagement member 40 comprises one element of such locking means. The other constituent element of the locking means are detents on the cover engageable with the tissue roll end engagement member. More specifically, two spaced detents 72 on the cover are alternately engageable with the toilet tissue roll end engagement member. A first detent (not shown) is cooperable with the toilet tissue roll end engagement member 40 to prevent sliding of the cover in the direction of end 12 of the housing and detent 72 is cooperable with the toilet tissue roll end engagement member 40 to prevent sliding of the cover in the direction of housing end 14. As will now be seen, the detents and toilet tissue roll end engagement member 40 will cooperate to lock the cover against sliding movement only up to the point where a toilet tissue roll is substantially depleted on a spindle toward which the cover is being manually urged. If a force is exerted on the cover 60 in the direction of a full toilet tissue roll, movement of the cover is prevented due to engagement of member 40 with an end of a roll 42 and by engagement of one of the detents with the member 40. Depletion of the toilet tissue roll allows the roll end engagement member 40 to be rotated about projection 38 as a result of force applied by manually sliding cover 60 such that the detent clears (or passes under) member 40 and cover 60 can be slid completely to the opposing end of the housing, thus exposing a new toilet tissue roll for user access thereto through opening 58.

Roll end engagement members in the form of ribs 90 project inwardly from the ends of the housing into the housing interior. Such ribs are observable only projecting from end 12 but it will be appreciated that like ribs project inwardly from housing end 14 as well. Ribs 90 are engageable by the ends of the toilet tissue rolls on the roll support spindles to prevent end-wise removal of the toilet tissue rolls from the roll support spindles while the second housing member 20 is in closed position.

FIGS. 1 and 2 also disclose each of the roll support spindles 32, 34 including a support shaft 78 and a sleeve 80 rotatably disposed about the support shaft for insertion into a toilet tissue roll. The roll support spindles 32, 34 may be utilized with coreless rolls of toilet tissue which typically have a small central opening. Each support shaft 78 is tapered at the outer end thereof to facilitate entry of the roll support spindle into the central opening of the coreless toilet tissue roll. The sleeve 80 further includes a tapered end having flexible elements or fingers 82 which are depressed inwardly upon insertion of the sleeve into a coreless toilet tissue roll so that there is frictional engagement between the flexible elements of the sleeve and the support shaft to resist rotation of the sleeve and the toilet tissue roll about the support shaft to an extent that the roll will not "freewheel" relative to the roll support spindle. However, due in part to the tapering of the sleeve end, the frictional force created against the support shaft may need to be increased in some instances. As a result, upon initiation of dispensing by a user, the tissue roll and sleeve 80 may have a tendency to over rotate about the spindle and thereby occasionally dispense more toilet tissue than desired under certain circumstances.

Accordingly, there is a need for an improved spindle sleeve for use in any free-spinning roll dispenser to increase the friction for the tearing of perforated sheet material and to substantially eliminate the excessive rotation of the sheet material roll and thereby prevent overspending of the sheet material.

SUMMARY OF THE INVENTION

The present invention relates to a spindle sleeve for use in an apparatus for dispensing from a single roll and for use in an apparatus for alternately dispensing, for example, toilet tissue from, for example, two coreless rolls of toilet tissue. The latter dispenser preferably includes a housing defining an interior compartment between opposing housing ends. The housing includes a first housing member and a second housing member connected thereto, the second housing member being movable relative to the first housing member between an open position and a closed position. A roll support structure within the interior compartment of the housing includes first and second roll support spindles for supporting therearound first and second coreless rolls of toilet tissue in a coaxial relationship.

A spindle sleeve is rotatably disposed over each of the roll support spindles for insertion into the coreless toilet tissue roll. Each of the spindle sleeves includes a first end adjacent to the roll support structure and a second end spaced from one end of the housing. The first end of the spindle sleeve includes a plurality of slotted openings defining a plurality of first finger elements and the second end of the spindle sleeve preferably includes a plurality of slotted openings defining a plurality of second finger elements. The first and second finger elements are compressed, upon insertion into preferably the coreless rolls of toilet tissue, to thereby engage the roll support spindles and provide frictional resistance to rotation.

The roll support structure includes a support frame pivotally connected to the first housing member, with the roll support spindles projecting outwardly from the support frame in opposing directions. A cover may also be slidably positioned on the second housing member and selectively slidably moved relative to the housing between a first cover location wherein the first roll of toilet tissue is exposed for user access and the second roll of toilet tissue is concealed and a second cover location wherein the second roll of toilet tissue is exposed for user access and the first roll of toilet tissue is concealed.

A further aspect of the present invention relates to a spindle sleeve rotatably disposed on a roll support spindle for insertion into a roll of sheet material. The spindle sleeve includes a first end adjacent to the roll support structure and a second end spaced from one end of the housing. The first end of the spindle sleeve includes a plurality of slotted openings defining a plurality of first finger elements, wherein the first finger elements are compressed upon insertion into the roll to thereby frictionally engage the roll support spindle and provide resistance to rotation. At least one of the first finger elements is constructed such that it increases the frictional engagement of the spindle sleeve and the roll support spindle.

BRIEF DESCRIPTION OF DRAWINGS

These, and other, objects, features and advantages of the present invention will become more readily apparent to those skilled in the art upon reading the following detailed description, in conjunction with the appended drawings, in which.

DETAILED DESCRIPTION OF A PREFERRED EMBODIMENT

Figure 1:
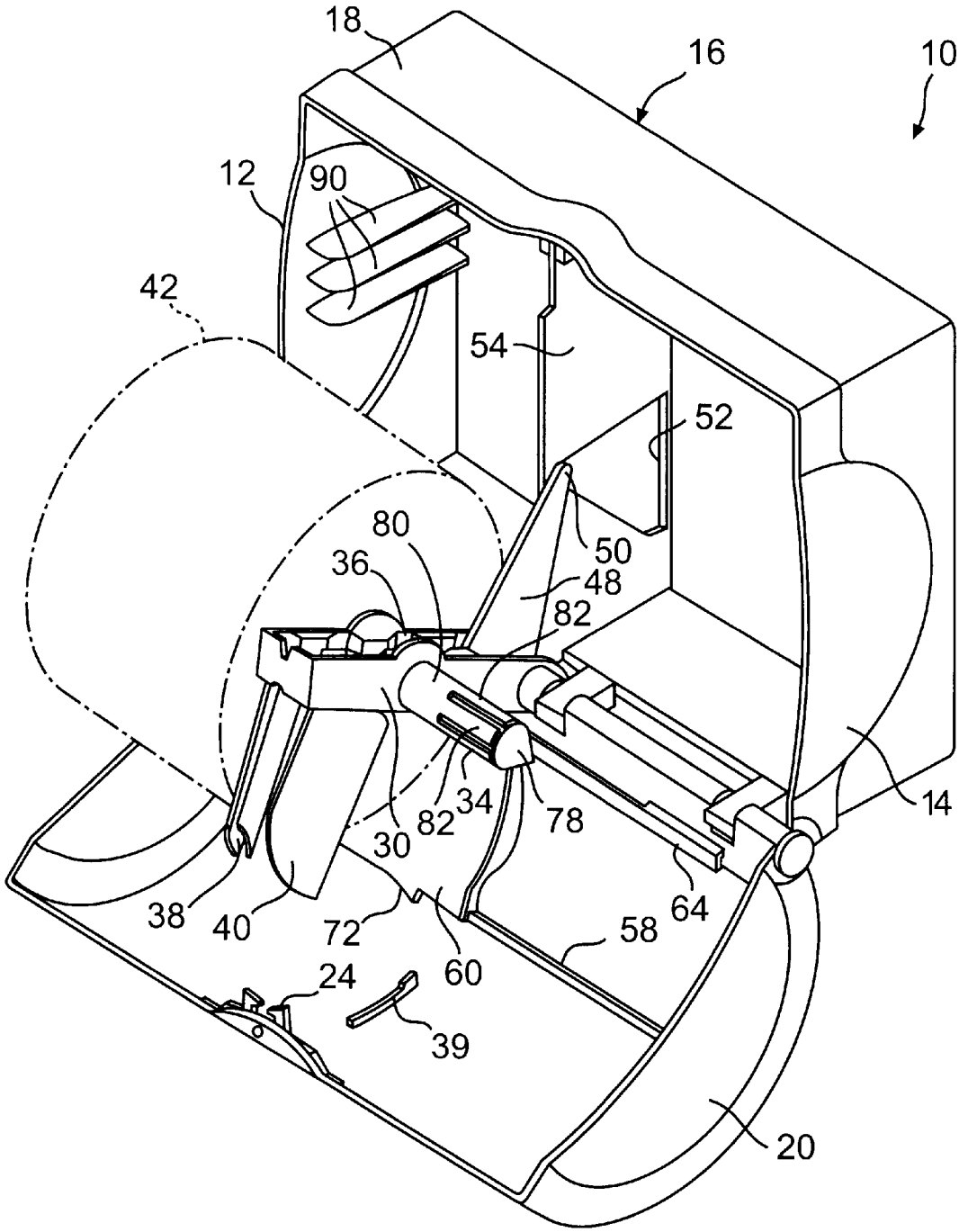
FIG. 1 (PRIOR ART)
FIG. 1 is a perspective view of a dispensing apparatus of the prior art showing the first and second housing members pivoted apart to disclose the interior mechanism of the apparatus including the roll support structure and locking means.
Figure 2:
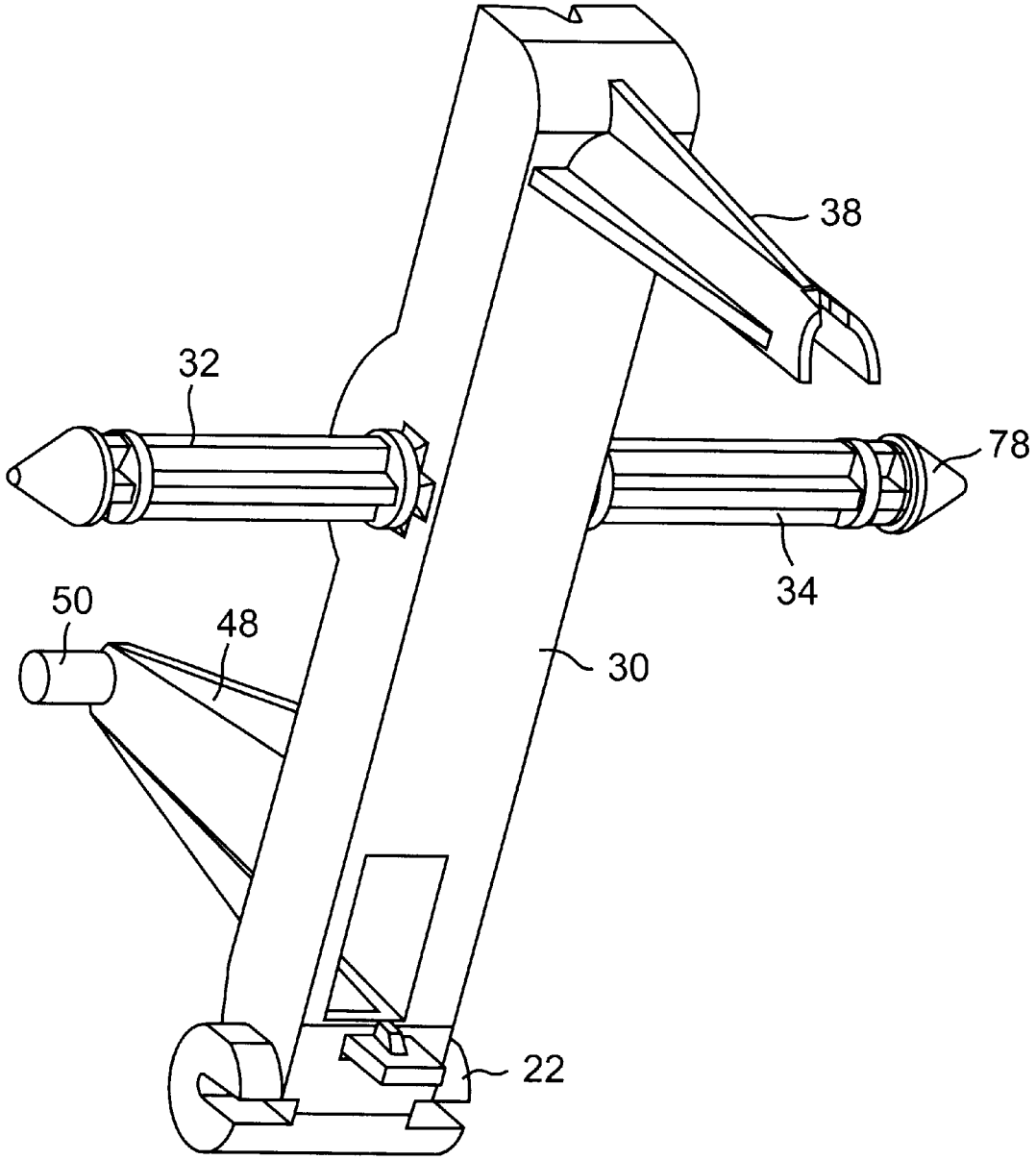
FIG. 2 (PRIOR ART)
FIG. 2 is an enlarged perspective view of the roll support structure shown in FIG. 1.
Figure 3:
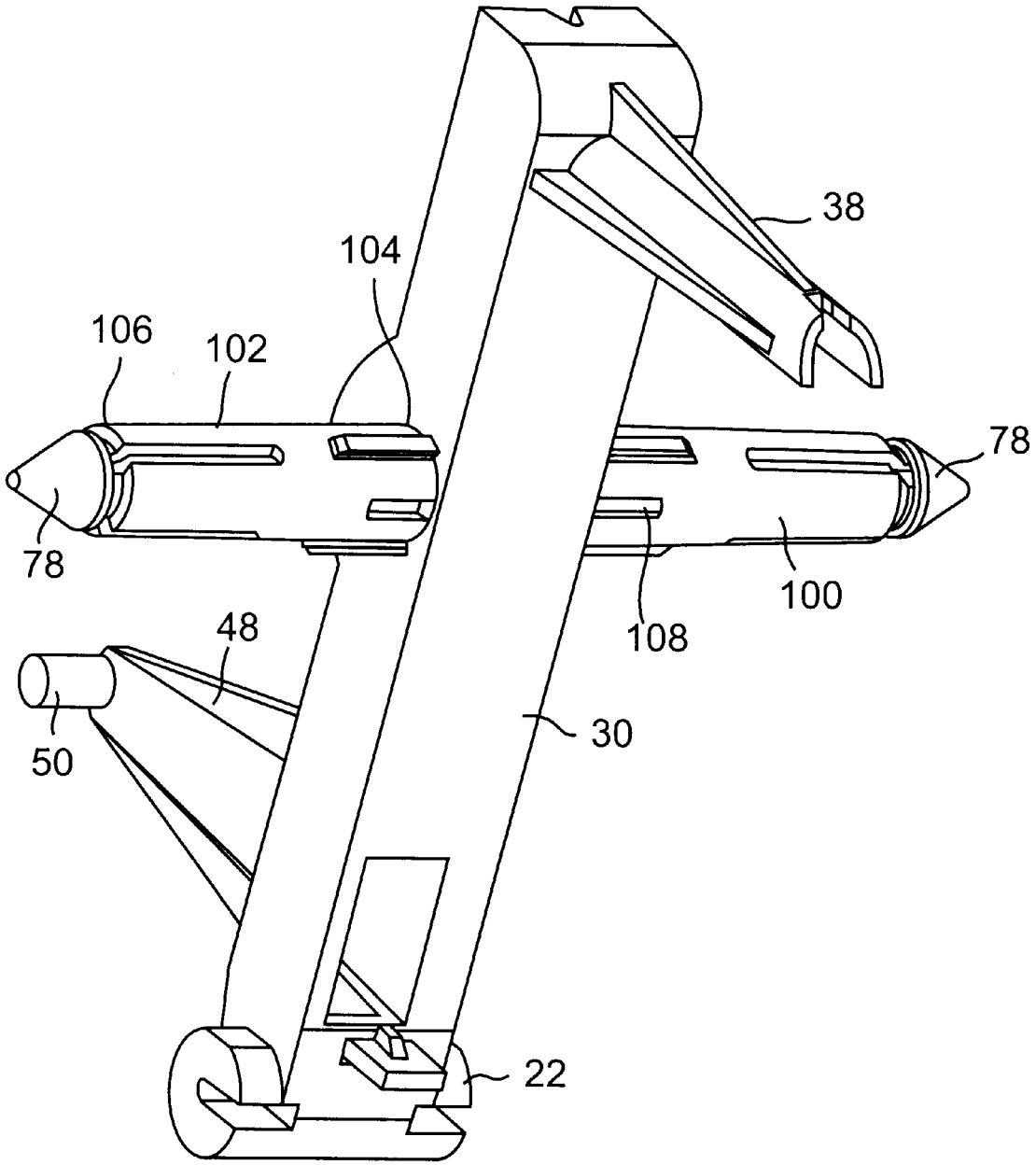
FIG. 3 is an enlarged perspective view of the roll support structure shown in FIG. 2 with a spindle sleeve in accordance with present invention disposed thereover.
Figure 4A:
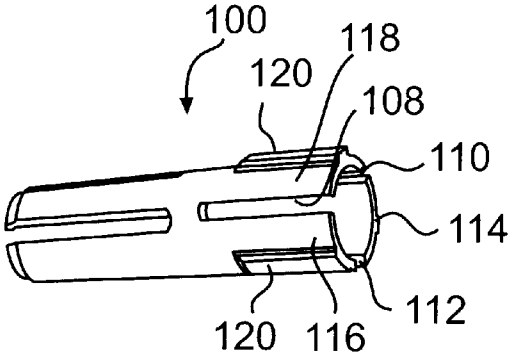
FIGS. 4(A)–4(D) are perspective views of the spindle sleeve of the present invention shown in FIG. 3.
Figure 4B:
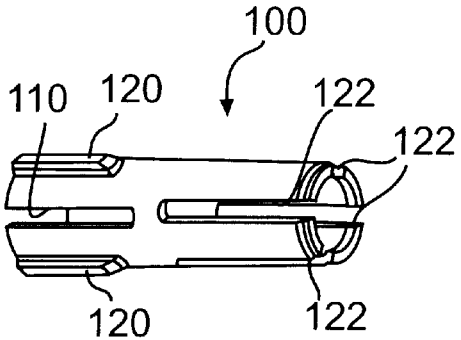
Figure 4C:
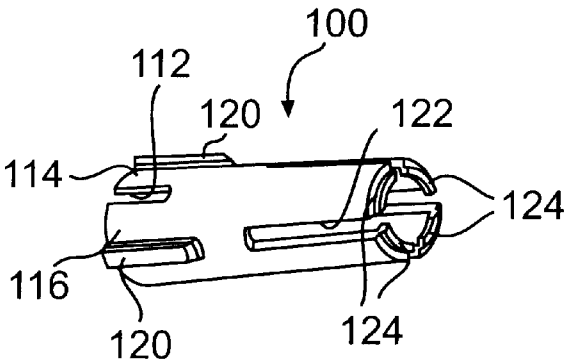
Figure 4D:
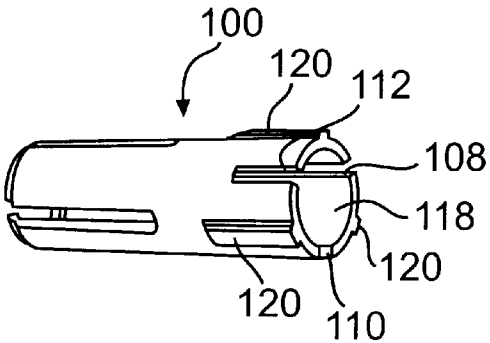

An improved spindle sleeve in accordance with the present invention is shown generally in FIG. 3, with like reference numerals being used to designate like elements of a preferred dispensing apparatus. The spindle sleeve of the present invention is designated generally by reference numeral 100, as shown disposed over support shaft 78 in FIG. 3. Spindle sleeve 100 includes a generally cylindrical body 102 having a first end 104 adjacent to the support frame 30 and a second end 106 adjacent to the tapered end of the support shaft 78. The sleeve 100 preferably also tapers slightly from a point approximately in the middle thereof toward the second end 106 in order to further guide the roll of sheet material onto the roll support spindles.

The first end 104 of sleeve 100 includes a plurality of slotted openings 108 disposed about the periphery thereof. In a preferred embodiment, the first end of the sleeve 100 includes three slotted openings 108, 110, 112, as shown in FIGS. 4(A)–4(D). Preferably, two of the slotted openings 108, 1 10 have a length that is approximately forty percent of the overall length of the sleeve 100. The remaining slotted opening 112 has a length less than that of openings 108, 110, preferably approximately one-half the length thereof.

The slotted openings 108, 110, 112 thus form three fingers 114, 116, 118. Sleeve 100 may be formed from any flexible material, most preferably plastic. The spindle sleeve of the present invention is useful in any free-spinning roll dispenser, reference is made to the following dispensing apparatus for illustration only and is not meant to be limiting. Fingers 114, 116, 118 are thereby made flexible and will be resiliently compressed against the support shaft 78 when a coreless roll of toilet tissue is placed thereover. Due to the differences in the length of the slotted openings, finger 118 formed between the longer slotted openings 108, 110 is more flexible than fingers 114, 116 which are formed on opposing sides of the shorter slotted opening 112. Thus, while fingers 114, 116 are resilient enough to be compressed against the support shaft, they are also rigid enough to assist in maintaining the structure of the sleeve 100. The second end 106 of sleeve 100 also includes a plurality of slotted openings disposed about the periphery thereof. In a preferred embodiment, the second end 106 includes four slotted openings 122, as shown in FIGS. 4(A)–4(D). Preferably, the slotted openings 122 are equally spaced around the periphery of the sleeve and have a length that is approximately fifty percent of the overall length of the sleeve 100.

The slotted openings 122 thus form four equally spaced fingers 124 around the second end 106 of the sleeve. Fingers 124 are also flexible and will be resiliently compressed against the support shaft 78 when a coreless roll of toilet tissue is placed thereover. Due to the length of the slotted openings 124, fingers 124 are more flexible than fingers 114, 116 formed on the first end 104 which are formed on opposing sides of the shorter slotted opening 112.

Thus, when a coreless roll of toilet tissue is disposed over the spindle support shaft 78, the innermost convolution of toilet tissue will contact the resilient fingers 124 on the second end of the sleeve. In so doing, the fingers will contact the support shaft and increase the frictional resistance therewith in order to prevent over-rotation of the toilet tissue roll during the dispensing thereof. As also discussed above relative to the prior art, however, due in part to limited contact area and the slight taper of the second end 106 of the spindle sleeve 100, the frictional resistance created by fingers 124 is sometimes desired to be increased so as to overcome the problem of over rotation and thus, over dispensing of the toilet tissue. Accordingly, the fingers 114, 116, 118 on the first end of the sleeve 100 of the present invention are also provided in order to increase the frictional resistance with the support shaft 78. Therefore, not only does the innermost convolution of toilet tissue compress the fingers 124, but resilient fingers 114, 116 and 118 are compressed as well against the support shaft 78, thereby increasing the frictional resistance to over rotation. In addition, each finger 114, 116, 118 of the present invention further includes an upstanding rib 120 extending radially outward therefrom. The addition of the ribs 120 increases the compression force exerted by the innermost convolution of toilet tissue and thereby increases the frictional resistance between the fingers 114, 116, 118 and the support shaft 78. As a result, the fingers on the first end of the sleeve 100 effectively reduce over rotation of the coreless roll of toilet tissue during dispensing, thereby preventing overspending of the toilet tissue and reducing the frequency at which the rolls must be replenished.

Figure 5:
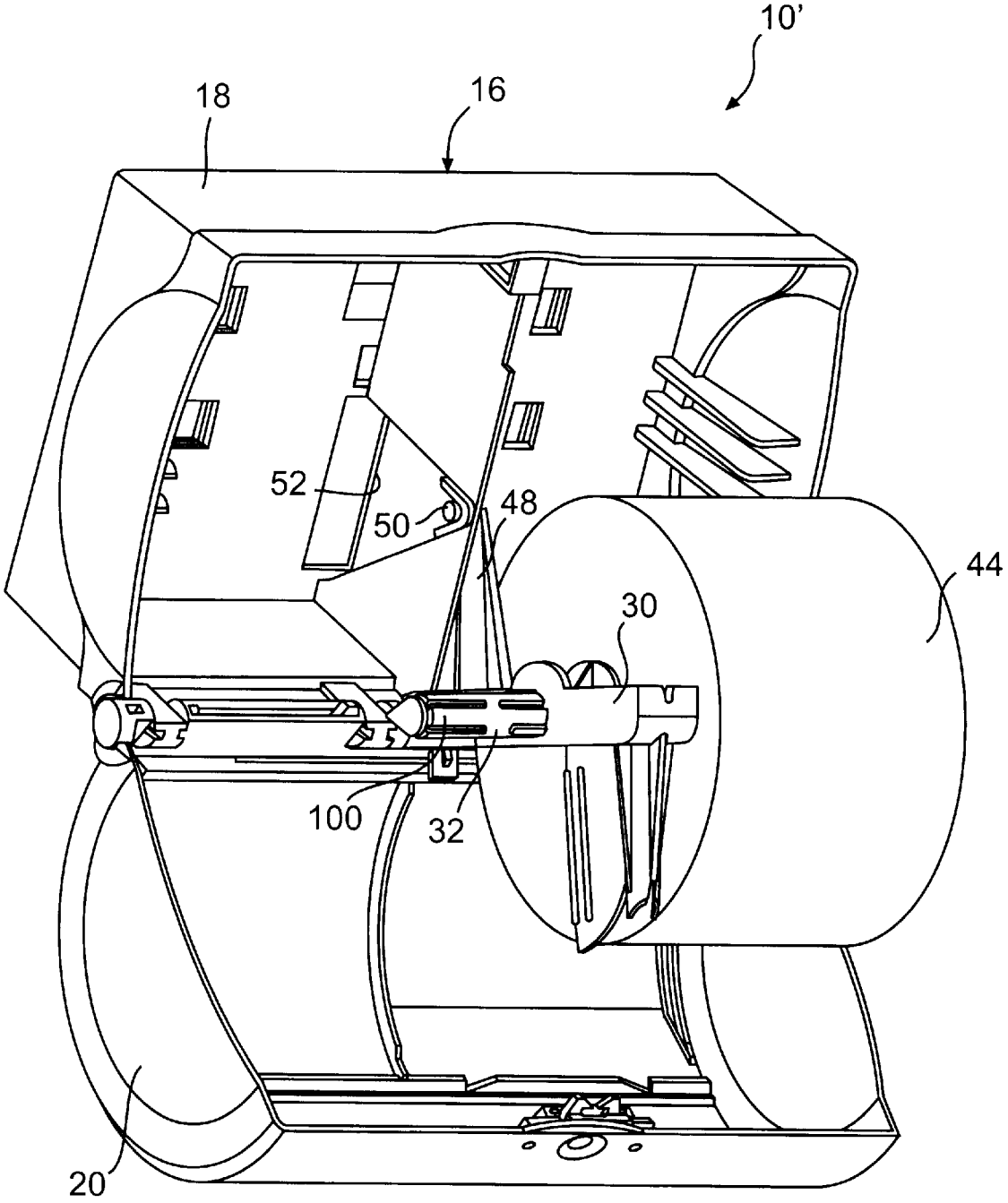
FIG. 5 is a perspective view of a dispensing apparatus in accordance with the present invention illustrating the housing members pivoted open and the roll support structure placed in a roll replenishment position.
Figure 6:
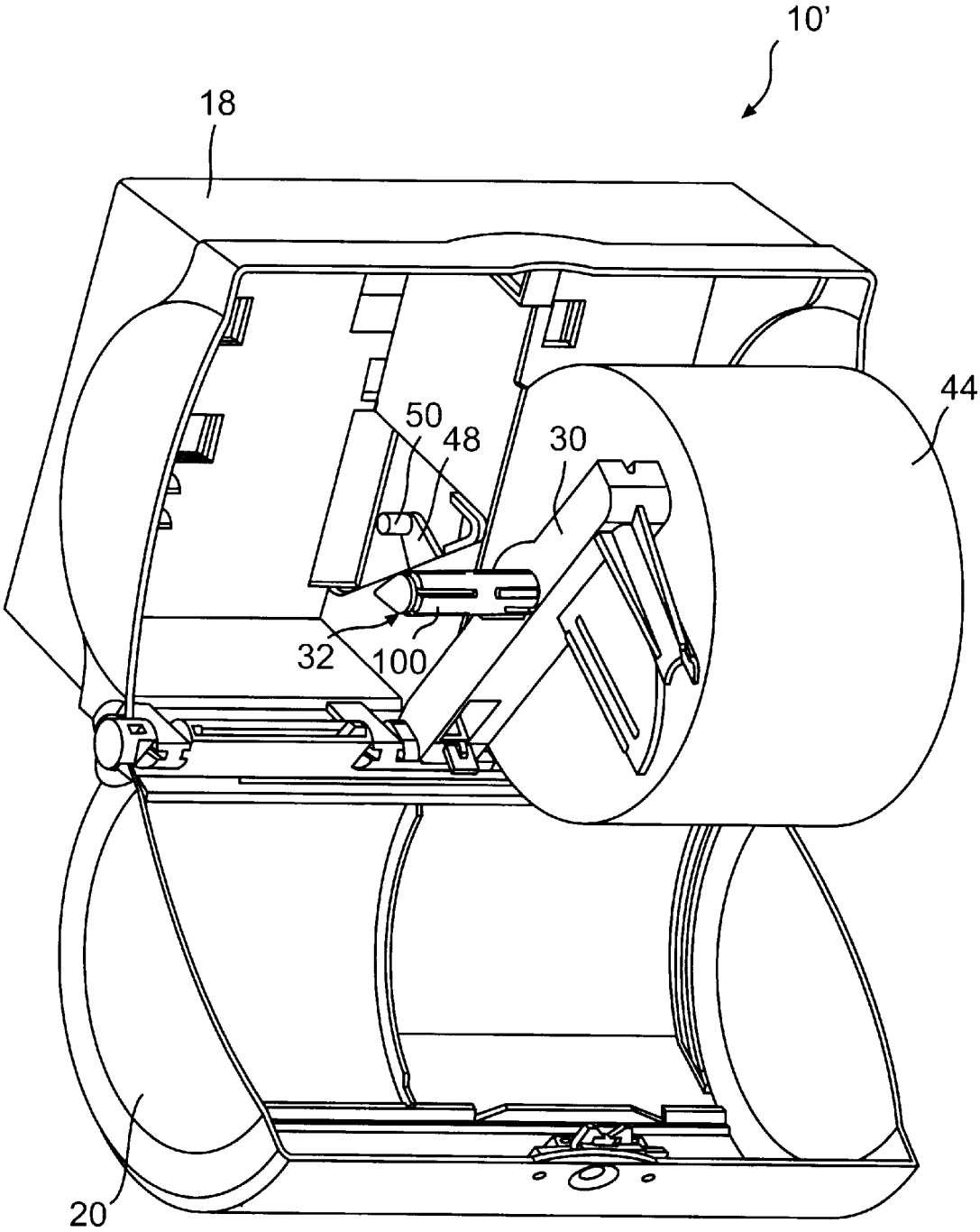
FIG. 6 is a perspective view thereof with the roll support structure in an intermediate position.
Figure 7:
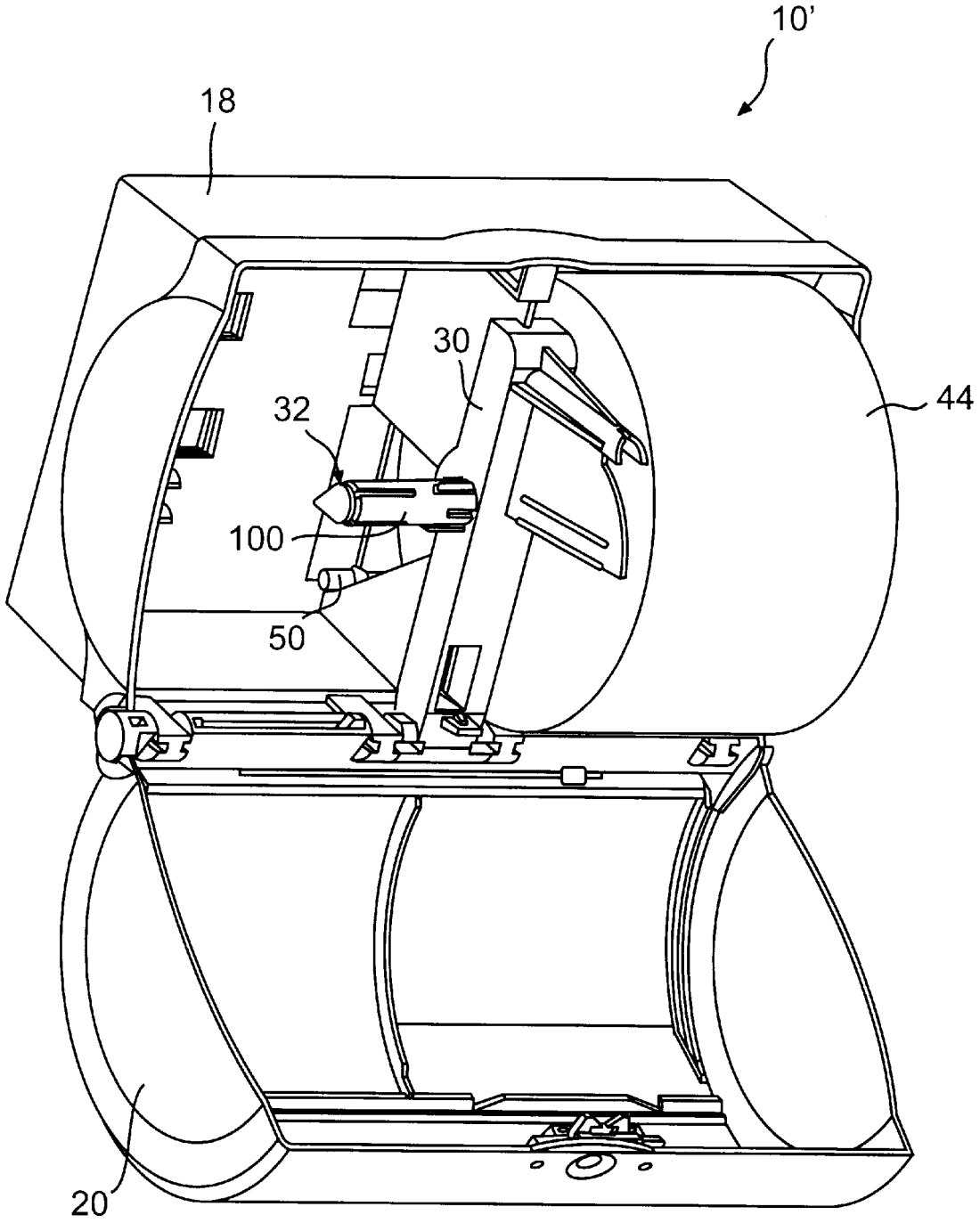
FIG. 7 is a perspective view of a dispensing apparatus in accordance with the present invention with the roll support structure placed in a dispensing position.

Referring also to FIGS. 5–7, the open and closed positions of the apparatus 10' of the present invention are further illustrated. In FIG. 5 the second housing member 20 is pivoted to an open position to allow access to the spindles 32, 34 and the sleeves 100 disposed thereover. In the open position, the spindles can be replenished with coreless rolls of toilet tissue 44 after a roll has been entirely used. That is, spindle 32 is readily accessible and a coreless roll of toilet tissue can be disposed over the sleeve 100 disposed thereon. As also shown in FIG. 5, the distal end 50 of the extension 48 engages the opening 52 and prevents the support frame 30 from pivoting too far away from the first housing member 18. FIG. 6 illustrates an intermediate pivot position wherein support frame 30 is moved between the dispensing position shown in FIG. 7 and the replenishment position of FIG. 5. FIG. 7 shows the vertically upright dispensing position of support frame 30.

The above-described exemplary embodiment is intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

I claim:

1. An apparatus for dispensing toilet tissue from coreless rolls of toilet tissue, said apparatus comprising:

a housing defining an interior between opposing housing ends, said housing including a first housing member and a second housing member connected to said first housing member and movable relative to said first housing member between an open position and a closed position;

roll support means including coaxial first and second roll support spindles for supporting therearound first and second coreless rolls of toilet tissue in a coaxial relationship; and a spindle sleeve rotatably disposed over each of said roll support spindles for insertion into a coreless toilet tissue roll, each said spindle sleeve including a first end adjacent said roll support means and an opposite second end adjacent to one end of said housing, said first end of each spindle sleeve including a plurality of first slotted openings defining a plurality of flexible first finger elements and said second end of each spindle sleeve including a plurality of second slotted openings defining a plurality of flexible second finger elements;

wherein said first and second finger elements are compressed upon insertion into the coreless rolls of toilet tissue to thereby engage said roll support spindles and provide frictional resistance to rotation.

2. The apparatus of claim 1 further comprising a cover slidably positioned on said second housing member and selectively slidably movable relative to said housing between a first cover location wherein said first roll of toilet tissue is exposed for manual access and said second roll of toilet tissue is not exposed for manual access and a second cover location wherein said second roll of toilet tissue is exposed for manual access and said first roll of toilet tissue is not exposed for manual access.

3. The apparatus of claim 1 wherein said roll support means further includes a support frame pivotally connected to said first housing member, said roll support spindles projecting outwardly from said support frame in opposed directions, pivotal movement of said support frame relative to said first housing member causing said roll support spindles to move either toward or away from said first housing member.

4. The apparatus of claim 1 wherein said second slotted openings are greater in length than said first slotted openings.

5. The apparatus of claim 1 wherein at least two of said first slotted openings defines a first slot length and at least one of said first slotted openings defines a second slot length, said first slot length being greater than said second slot length.

6. The apparatus of claim 5 wherein said second slotted openings define a third slot length, said third slot length being greater than said first and second slot lengths.

7. The apparatus of claim 5 wherein one of said plurality of first finger elements is defined between said at least two first slotted openings defining said first slot length, said one of said first finger elements having a greater flexibility than a remainder of said plurality of first finger elements.

8. The apparatus of claim 1 wherein at least one of said first finger elements includes means for increasing the compression of said at least one first finger element against said respective roll support spindle upon insertion into the coreless roll of toilet tissue, thereby increasing frictional engagement of said spindle sleeve and roll of toilet tissue with said roll support spindle and providing increased resistance to rotation.

9. The apparatus of claim 8 wherein said compression increasing means includes a rib extending radially outwardly from an exterior surface of said at least one of said first finger elements.

10. In an apparatus for dispensing toilet tissue from coreless rolls of toilet tissue, said apparatus comprising a housing defining an interior between opposing housing ends, roll support means including at least one roll support spindle for supporting therearound at least one coreless roll of toilet tissue, the improvement comprising:

a spindle sleeve rotatably disposed on said at least one roll support spindle for insertion into the coreless toilet tissue roll, said spindle sleeve including a first end adjacent the roll support means and an opposite second end adjacent to one end of the housing, said first end of said spindle sleeve including a plurality of slotted openings defining a plurality of first finger elements, said first finger elements being compressed upon insertion into the coreless roll of toilet tissue to thereby frictionally engage the roll support spindle and provide resistance to rotation, at least one of said first finger elements further including means for increasing the frictional engagement of said spindle sleeve and the roll support spindle, said frictional engagement increasing means including a rib extending radially outwardly from an exterior surface of said at least one of said first elements and situated circumferentially between said slotted openings defining said at least one first finger element and extending generally parallel to said slotted openings.

11. In an apparatus for dispensing toilet tissue from coreless rolls of toilet tissue, said apparatus comprising a housing defining an interior between opposing housing ends, roll support means including at least one roll support spindle for supporting therearound at least one coreless roll of toilet tissue, the improvement comprising:

a spindle sleeve rotatably disposed on said at least one roll support spindle for insertion into the coreless toilet tissue roll, said spindle sleeve including a first end adjacent the roll support means and a second end adjacent to one end of the housing, said first end of said spindle sleeve including a plurality of slotted openings defining a plurality of first finger elements, said first finger elements being compressed upon insertion into the coreless roll of toilet tissue to thereby frictionally engage the roll support spindle and provide resistance to rotation, at least one of said first finger elements further including means for increasing the frictional engagement of said spindle sleeve and the roll support spindle;

wherein said second end of said spindle sleeve includes a plurality of slotted openings defining a plurality of second finger elements.

12. A spindle sleeve comprising:

a generally cylindrical body member having a first end, a middle portion, and a second end;

said first end including a plurality of first slotted openings defining a plurality of first finger elements therebetween, at least one of said plurality of first finger elements including a means for increasing an effective diameter of said generally cylindrical body member;

wherein said second end includes a plurality of second slotted openings defining a plurality of second finger elements therebetween.

13. A spindle sleeve comprising:

a generally cylindrical body member having a first end, a middle portion, and a second end; and said first end including a plurality of first slotted openings defining a plurality of first finger elements therebetween, at least one of said plurality of first finger elements including a means for increasing an effective diameter of said generally cylindrical body member, wherein said effective diameter increasing means includes a rib extending radially outwardly from an exterior surface of said at least one finger element, said rib situated circumferentially between said slotted openings defining said at least one first finger element and extending generally parallel to said slotted openings.

14. The spindle sleeve of claim 13 wherein said second end includes a plurality of second slotted openings defining a plurality of second finger elements therebetween.

15. The spindle sleeve of claim 13 wherein said cylindrical body member tapers from said middle portion toward said second end such that a diameter of said second end is smaller than a diameter of said first end.

16. The spindle sleeve of claim 15 wherein each of said plurality of first finger elements includes said effective diameter increasing means.

17. The spindle sleeve of claim 13 wherein said plurality of first slotted openings include at least one of said first slotted openings having a first slot length and at least one of said first slotted openings having a second slot length, said first slot length being greater than said second slot length.

18. A spindle sleeve comprising:

a generally cylindrical body member having a first end, a middle portion, and a second end; and said first end including a plurality of first slotted openings defining a plurality of first finger elements therebetween, at least one of said plurality of first finger elements including a means for increasing an effective diameter of said generally cylindrical body member;

wherein said plurality of first slotted openings includes at least one of said first slotted openings having a first slot length and at least one of said first slotted openings having a second slot length, said first slot length being greater than said second slot length.

19. An apparatus for dispensing sheets from a roll of sheet material, said apparatus comprising:

a housing defining an interior between opposing housing ends;

a roll support including a roll support spindle for supporting therearound a roll of sheet material; and a spindle sleeve rotatably disposed over said roll support spindle for insertion into a core of the roll, said spindle sleeve including a first end adjacent said roll support and a second opposite end adjacent to one end of said housing, said first end of said spindle sleeve including a plurality of first slotted openings defining a plurality of flexible first finger elements and said second end of said spindle sleeve including a plurality of second slotted openings defining a plurality of second flexible finger elements;

wherein said first and second finger elements are compressed upon insertion into the core of the roll to thereby engage said roll support spindle and provide frictional resistance to rotation.

20. The apparatus of claim 19 wherein said second slotted openings are greater in length than said first slotted openings.

21. The apparatus of claim 19 wherein at least two of said first slotted openings define a first slot length and at least one of said first slotted openings defines a second slot length, said first slot length being greater than said second slot length.

22. The apparatus of claim 21 wherein said second slotted openings define a third slot length, said third slot length being greater than said first and second slot lengths.

23. The apparatus of claim 21 wherein one of said plurality of first finger elements is defined between said at least two first slotted openings defining said first slot length, said one of said first finger elements having a greater flexibility than a remainder of said plurality of first finger elements.

24. The apparatus of claim 19 wherein at least one of said first finger elements includes a rib extending radially from an exterior surface thereof, said rib increasing the compression of said at least one first finger element against said roll support spindle upon insertion into the roll of sheet material, thereby increasing frictional engagement of said spindle sleeve and roll of sheet material with said roll support spindle and providing increased resistance to rotation.

25. In an apparatus for dispensing toilet tissue from coreless rolls of toilet tissue, said apparatus comprising a housing defining an interior between opposing housing ends, a roll support including at least one roll support spindle for supporting therearound at least one coreless roll of toilet tissue, the improvement comprising:

a spindle sleeve rotatably disposed on said at least one roll support spindle for insertion into the coreless toilet tissue roll, said spindle sleeve including a first end adjacent the roll support and a second end adjacent to one end of the housing, said first end of said spindle sleeve including a plurality of slotted openings defining a plurality of first finger elements, said first finger elements being compressed upon insertion into the coreless roll of toilet tissue to thereby frictionally engage the roll support spindle and provide resistance to rotation, at least one of said first finger elements further including a surface extending radially from said spindle sleeve, thereby increasing an effective diameter of said sleeve to thus increase the frictional engagement of said spindle sleeve and the roll support spindle;

wherein said second end of said spindle sleeve includes a plurality of slotted openings defining a plurality of second finger elements.

26. A spindle sleeve comprising:

a generally cylindrical body member having a first end, a middle portion, and a second end;

said first end including a plurality of first slotted openings defining a plurality of first finger elements therebetween, at least one of said plurality of first finger elements including a surface extending radially outwardly from said generally cylindrical body member, thereby increasing an effective diameter of said generally cylindrical body member;

wherein said second end includes a plurality of second slotted openings defining a plurality of second finger elements therebetween.

* * * * *